US006811431B2

(12) United States Patent
Hsieh

(10) Patent No.: US 6,811,431 B2
(45) Date of Patent: Nov. 2, 2004

(54) CONNECTOR

(75) Inventor: Yung-Tsun Hsieh, Chang Hua Hsien (TW)

(73) Assignee: Benq Corporation, Taoyuan (TW)

( * ) Notice: Subject to any disclaimer, the term of this patent is extended or adjusted under 35 U.S.C. 154(b) by 0 days.

(21) Appl. No.: 10/690,245

(22) Filed: Oct. 21, 2003

(65) Prior Publication Data

US 2004/0082211 A1 Apr. 29, 2004

(30) Foreign Application Priority Data

Oct. 22, 2002 (TW) ..... 91216884 U

(51) Int. Cl.[7] ..... H01R 12/24

(52) U.S. Cl. ..... 439/495; 439/67; 439/77; 439/329; 381/322; 381/323

(58) Field of Search ..... 439/500, 495, 439/496, 67, 77, 620, 329; 381/322, 323

(56) References Cited

U.S. PATENT DOCUMENTS 3,149,897 A * 9/1964 Martineck ..... 439/494
3,226,668 A * 12/1965 Baer et al. ..... 439/354
5,397,247 A * 3/1995 Aoki et al. ..... 439/496
6,319,020 B1 * 11/2001 Brimhall et al. ..... 439/77
6,482,027 B2 * 11/2002 Ishii et al. ..... 439/495
6,595,796 B1 * 7/2003 Koegel et al. ..... 439/495

* cited by examiner

*Primary Examiner*—Tho D. Ta
(74) *Attorney, Agent, or Firm*—Ladas & Parry

(57) ABSTRACT

A connector for connecting a contact pad of a flexible printed circuit board against terminals of an electronic component comprises a body and a reinforcing plate, wherein the body is combined with the electronic component and two parallel sliding channels are mounted on the body corresponding to two sides of the terminals of the electronic component, and the reinforcing plate is combined with the contact pad of the flexible printed circuit board so as to increase the stiffness of the contact pad, and two sides of the reinforcing plate cooperate with the two parallel sliding channels of the body, thereby connecting the contact pad of the flexible printed circuit board against the terminals of the electronic component.

18 Claims, 4 Drawing Sheets

CONNECTOR

FIELD OF THE INVENTION

The present invention relates to a connector, more particularly, to a connector through which a contact pad of a flexible printed circuit board is connected against terminals of an electronic component.

BACKGROUND OF THE INVENTION

A flexible printed circuit board (FPC) is one kind of the printed circuit boards. Since the flexible printed circuit board has a property of flexibility, it can be used in a three-dimensional wiring according to the size and shape of products and it is quite suitable to compact and light electronic products. Hence, the flexible printed circuit board is usually applied in highly delicate products such as a notebook computer, a portable optical disc drive, a printer, a cellular phone, a digital camera and electronic equipment for motor vehicles etc. Many integrated circuits (ICs) of different functions are mounted on the surface of the flexible printed circuit board. The ICs are combined with the flexible printed circuit board by a packaging technology of chip on film (often referred to simply as COF). The combined ICs and the circuits distributed on the surface of the flexible printed circuit board are mutually electrically communicated, and the above circuits are extended to an end portion of the flexible printed circuit board and a contact pad of the flexible printed circuit board is thus formed. The contact pad can also be called as an electrode or a terminal. The ICs on the surface of the flexible printed circuit board are connected through the contact pad to remote electronic components such as speakers, receivers, microphones or oscillators etc., so as to achieve the goal of signal connection.

Please refer to FIG. 1, which is a schematic location diagram of a contact pad 12 of a conventional flexible printed circuit board 10 in related to a speaker 16 of a mobile phone. In order to clearly display the connection between the flexible printed circuit board 10 and the speaker 16, as shown in FIG. 1, the front panel of the housing of the mobile phone is laid face downward, and a container 18 for receiving the speaker 16 is mounted at an appropriate position of the housing. The bottom of the container 18 has sound apertures 181. The front of the speaker 16 is combined to the bottom of the container 18 and corresponds to the sound apertures 181, and terminals 161 are mounted on the back of the speaker 16. In the prior art, the methods used for combination of the flexible printed circuit board 10 and the speaker 16 mainly includes: (a) a welding method, in which the contact pad 12 of the flexible printed circuit board 10 and the terminals 161 of the speaker 16 are welded together directly by tin solder; (b) a conductive rubber contacting method, in which conductive rubber is used to combine the contact pad 12 of the flexible printed circuit board 10 with the terminals 161 of the speaker 16; and (c) a leaf spring contacting method, in which the terminals 161 of the speaker 16 are respectively designed to be a leaf spring structure and protrude from the back of the speaker 16, and then the contact pad 12 of the flexible printed circuit board 10 is placed on the terminals 161, and lastly the back panel (not shown) of the housing is used to cover the contact pad 12 of the flexible printed circuit board 10 and the speaker 16 up so as to maintain the contact pad 12 in contact with the terminals 161.

In the aforesaid methods, the materials used in the welding method would pollute the environment, and after completion of the welding, the welding is difficult to rework if the speaker 16 is ineffective and must be replaced. Furthermore, the conductive rubber contacting method costs high. The leaf spring contacting method has no disadvantages of the above-mentioned two methods, but the contact pad is in ill contact with the terminals since coverage of the back panel of the housing is difficult and the contact pad of the flexible printed circuit board is liable to slip out of the surface of the terminals of the speaker.

Therefore, the related R&D engineers have made every effort to improve the combination of the contact pad of the flexible printed circuit board with the terminals of the speaker and to attain the products of low costs and superior combinations.

SUMMARY OF THE INVENTION

The objective of the present invention is to provide a connector so as to secure the combination of a contact pad of a flexible printed circuit board and terminals of an electronic component more firmly and to facilitate the combining operation.

The connector of this invention includes a body and a reinforcing plate. The body has a container for receiving an electronic component, and elastic terminals are mounted on the back of the electronic component and protrude from the container when the electronic component is received in the container, and two parallel sliding channels are mounted on the two sides of the body corresponding to the two sides of the elastic terminals of the electronic component. The reinforcing plate is combined with the back of the contact pad of the flexible printed circuit board so as to increase the stiffness of the contact pad without influencing the electrical function of the contact pad, and the two sides of the reinforcing plate can cooperate with the two parallel sliding channels of the body such that the two sides of the reinforcing plate can be slipped into or drawn out from the sliding channels.

When the connector of this invention is operated, the two sides of the reinforcing plate are slipped into the two parallel sliding channels of the body, wherein the contact pad with which the reinforcing plate is combined faces to the terminals of the electronic component which is received in the container. Hence, after the reinforcing plate are slipped into the two parallel sliding channels of the body, the contact pad of the flexible printed circuit board is simultaneously connected against the terminals of the electronic component.

Preferably, a positioning protrusion can be mounted at an appropriate location of the surface of each sliding channel of the body in this invention, and also an indentation is mounted at the corresponding location of each of the two sides of the reinforcing plate. After the reinforcing plate is slipped into the sliding channels, the positioning protrusions are respectively locked into the indentations so as to have a firmer combination of the body with the reinforcing plate and to keep the contact pad of the flexible printed circuit board in contact with the terminals of the electronic component.

Preferably, the body of the connector of this invention and the electronic component may be formed in a piece. The contact pad of the flexible printed circuit board can be firstly combined with the electronic component to be a module by means of the connector, and then the whole module is assembled into the housing of the product so as to increase convenience of the combining operation of the contact pad and the terminals.

Preferably, the connector of this invention can be applied in highly delicate products such as a notebook computer, a portable optical disc drive, a printer, a cellular phone, a digital camera and electronic equipment for motor vehicles etc., and the electronic components to be connected can be speakers, receivers, microphones or oscillators etc.

In one of the examples of this invention, the connector is applied in the speaker of a cellular phone. The container of the body is combined onto the front plate of the housing of the cellular phone, and the bottom of the container has at least one opening thereon. After the speaker is received in the container, the sound of the speaker is come out from the opening(s) and the area of the opening should be smaller than that of the speaker. Furthermore, if the flexible printed circuit board and the body of the connector are not on the same level, the flexible printed circuit board may be formed as a stair-like shape to have the level of the contact pad at the edge portion of the flexible printed circuit board matched up to the height of the body of the connector so as to keep the contact pad in contact with the terminals of the speaker of the body.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

The connector of this invention is employed to combine a contact pad of a flexible printed circuit board and terminals of an electronic component. Through the connector, the contact pad is electrically connected to the terminals. This invention can be applied in highly delicate products such as a notebook computer, a portable optical disc drive, a printer, a cellular phone, a digital camera and electronic equipment for motor vehicles etc., and the electronic components to be connected can be speakers, receivers, microphones or oscillators etc. The connection of a speaker of a mobile phone with the flexible printed circuit board is given for illustration as a best mode of the connector of this invention.

Figure 1:
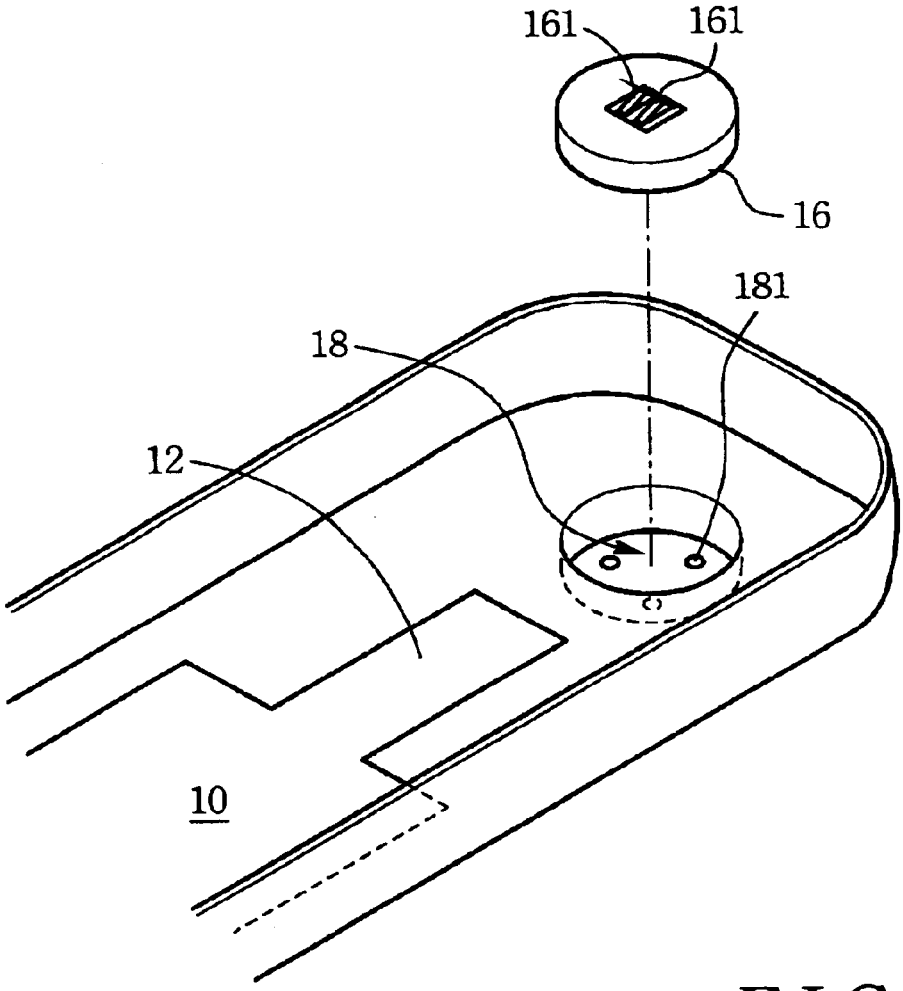
FIG. 1 (Prior Art)
FIG. 1 is a schematic location diagram of a contact pad of a conventional flexible printed circuit board related to a speaker of a mobile phone.
Figure 2A:
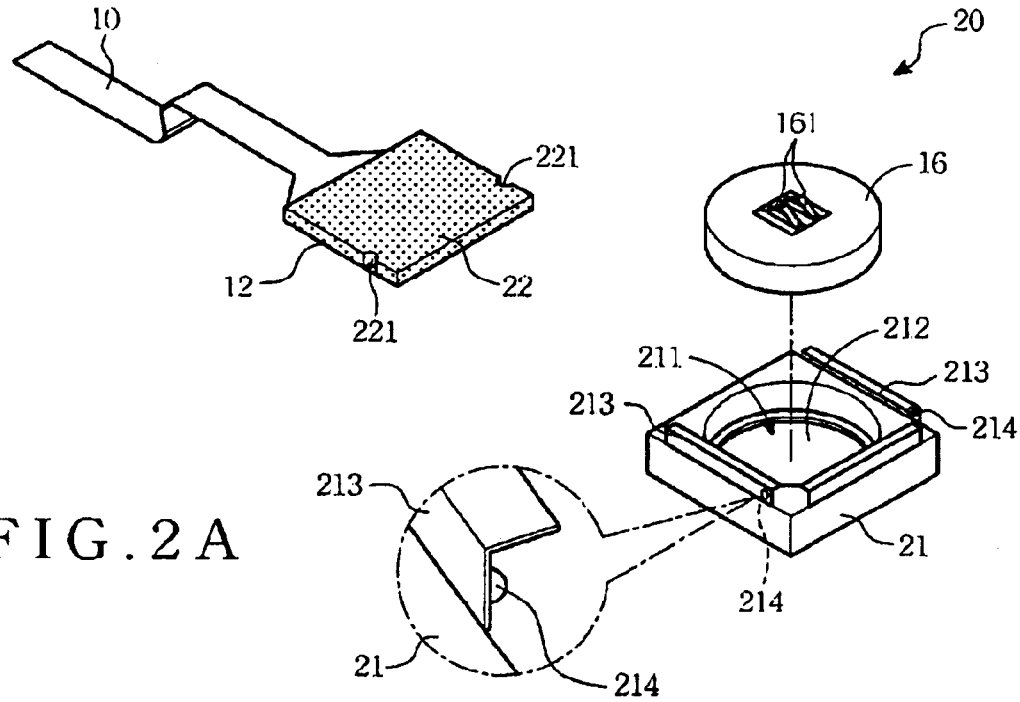
FIG. 2A is an exploded perspective diagram from a top view illustrating the combination of the speaker and the connector in accordance with this invention.
Figure 2B:
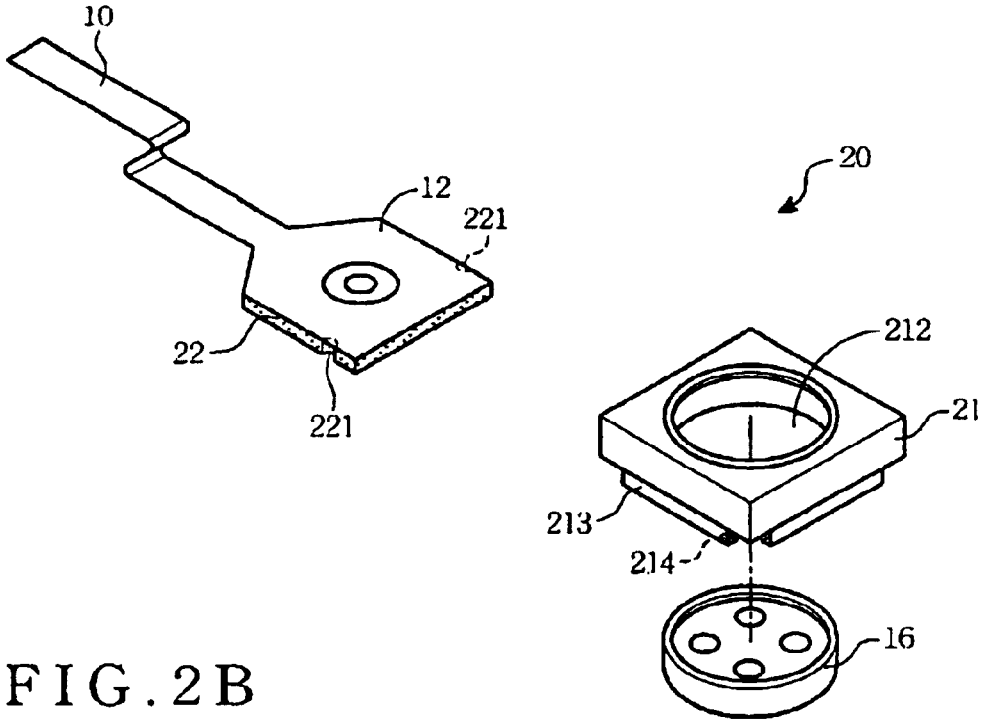
FIG. 2B is an exploded perspective diagram from a bottom view illustrating the combination of the speaker and the connector in accordance with this invention.
Figure 3A:
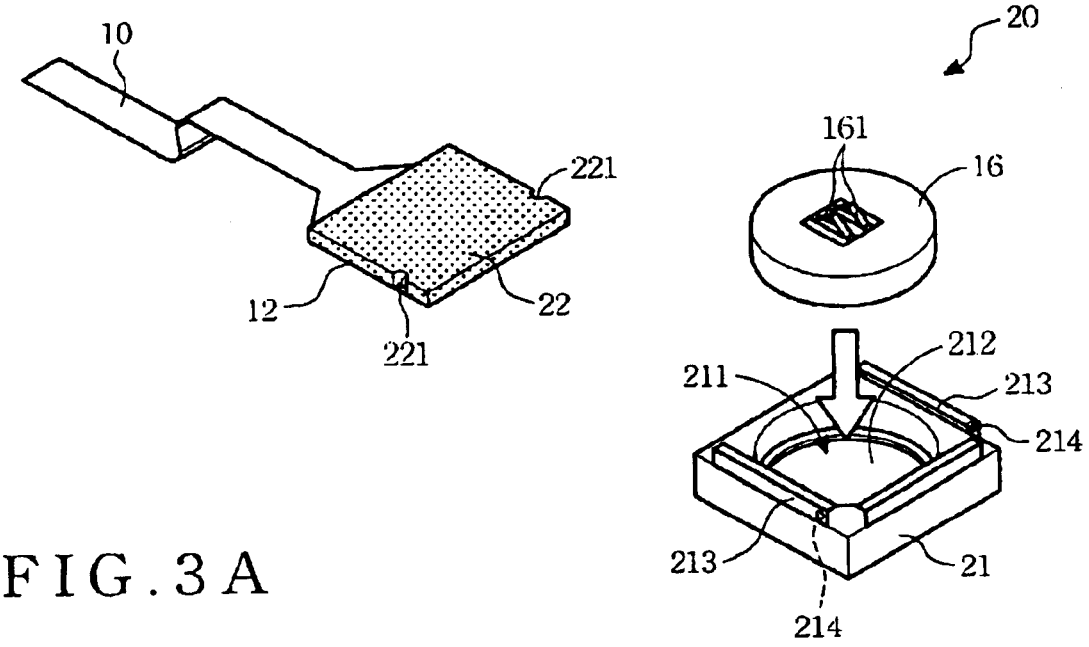
FIGS. 3A to 3D are schematic operation diagrams showing the combination of the contact pad of the flexible printed circuit board with the terminals of the speaker by the connector in accordance with this invention.
Figure 3B:
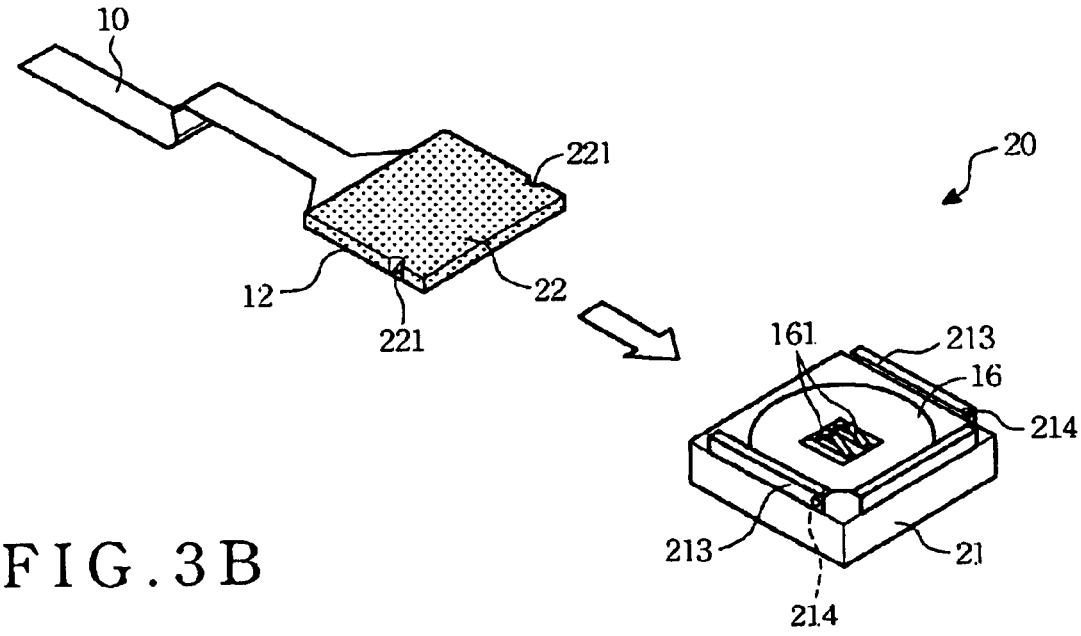
Figure 3C:
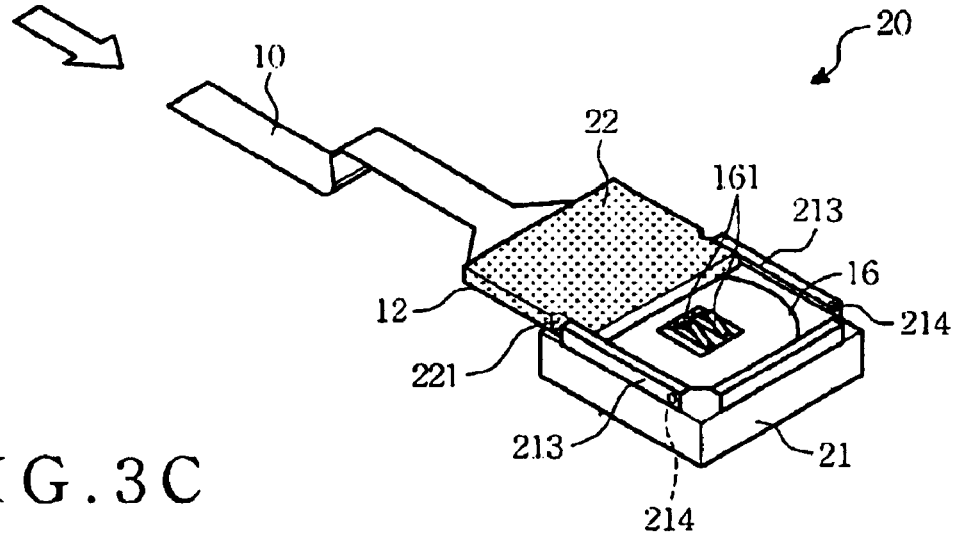
Figure 3D:
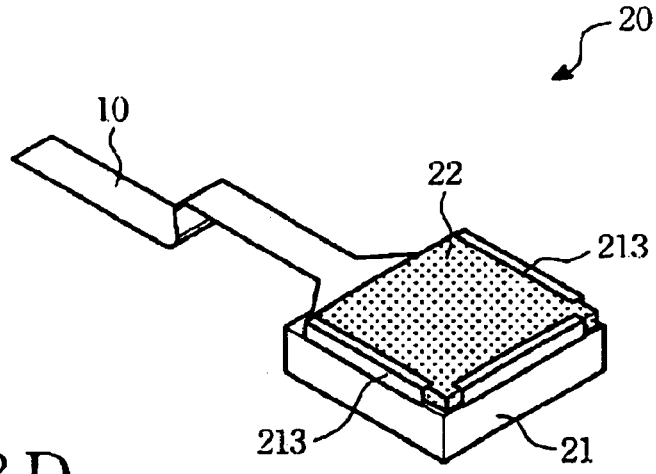

Please refer to FIGS. 2A and 2B, which are exploded perspective diagrams respectively from a top view and from a bottom view illustrating the combination of the speaker 16 and the connector 20 of this invention. In FIGS. 2A and 2B, the connector 20 includes a body 21 and a reinforcing plate 22, wherein the body 21 has a container 211 for receiving the speaker 16, and the bottom of the container 211 is combined with the front panel of the housing of the mobile phone (not shown) and has an opening 212 thereon. The front of the speaker 16 corresponds to the opening 212. The sound of the speaker 16 comes out from the opening 212, and the area of the opening 212 should be smaller than that of the speaker 16 so as to prevent the speaker from dropping out. Elastic terminals 161 are mounted on the back of the speaker 16 and protrude from the container when the speaker 16 is received in the container 211. Furthermore, two parallel sliding channels 213 are mounted on the two sides of the body 21 corresponding to the two sides of the elastic terminals 161 of the speaker 16, and a positioning protrusion 214 is mounted at the inner surface of each sliding channel 213.

The reinforcing plate 22 is combined with the back of the contact pad 12 of the flexible printed circuit board so as to improve the stiffness of the contact pad 12 without influencing the electrical function of the contact pad 12. The two sides of the reinforcing plate 22 can cooperate with the two parallel sliding channels 213 of the body 21 such that the two sides of the reinforcing plate 22 can be slipped into or drawn out from the sliding channels 213. In addition, an indentation 221 is mounted at each of the two sides of the reinforcing plate 22. After the reinforcing plate 22 is slipped into the sliding channels 213, the positioning protrusions 214 are respectively locked into the indentations 221 so as to have a firmer combination of the body 21 with the reinforcing plate 22. For the artisans in this art, the locking manner in this invention is easily modified to achieve the effect upon maintaining the firm combination of the body and the reinforcing plate. For instance, the disposition of the positioning protrusions and the indentations may by changed or other similar locking means are used.

Referring to FIGS. 3A to 3D, when the connection 20 of this invention is operated, the speaker 16 is firstly received in the container 211 of the body 21, and then the two sides of the reinforcing plate 22 are slipped into the two parallel sliding channels 213 of the body 21, wherein the contact pad 12 with which the reinforcing plate 22 is combined faces the terminals 161 of the speaker 16 which is received in the container 211. Hence, after the reinforcing plate 22 slipped into the two parallel sliding channels 213 of the body 21, the contact pad 12 of the flexible printed circuit board 10 is simultaneously connected against the terminals 161 of the speaker 16 so as to achieve the effect of electrical connection. In addition, when combining, if the flexible printed circuit board 10 and the body 21 of the connector 20 are not on the same level, the flexible printed circuit board 10 may be formed as a shape of stairs to have the level of the contact pad 12 at the edge portion of the flexible printed circuit board 10 to match up to the height of the body 21 of the connector 20 so as to facilitate assembling the connector 20 and to keep the contact pad 12 in contact with the terminals 161 of the speaker 16 of the body 21.

In this invention, the body of the connector and the speaker may be formed in one piece. The contact pad of the flexible printed circuit board is firstly combined with the speaker to be a module through the connector, and then the whole module is assembled into the front plate of the housing of the mobile phone and the back plate of the housing is covered thereon to complete the assembly. Furthermore, any stiff materials without affecting the electricity of the contact pad can be used for the reinforcing plate of this invention. Alternatively, the back of the contact pad 12 is coated with hardened resin to achieve the same stiff effect.

As is understood by a person skilled in the art, the foregoing preferred embodiment of the present invention is illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. A connector for connecting a contact pad of a flexible printed circuit board against terminals of an electronic component, comprising:

a body, on which two parallel sliding channels are mounted corresponding to two sides of the terminals of the electronic component, the body having a container in which the electronic component is received and when the body is combined with the electronic component, the terminals of the electronic component protrude from the container; and a reinforcing plate, combined with the contact pad of the flexible printed circuit board so as to increase the stiffness of the contact pad;

wherein two sides of the reinforcing plate cooperate with the two parallel sliding channels of the body, such that the contact pad of the flexible printed circuit board is connected against the terminals of the electronic component.

2. The connector of claim 1, wherein the electronic component includes a speaker, a receiver, a microphone or an oscillator.

3. The connector of claim 1, wherein the electronic component is a speaker, and the bottom of the container has an opening therein and the sound of the speaker comes out from the opening and the area of the opening is smaller than the area of the speaker.

4. The connector of claim 1, wherein the body and the electronic component are formed in one piece.

5. The connector of claim 1, wherein a positioning protrusion is mounted at each sliding channel of the body, and an indentation is mounted at a corresponding location of each of the two sides of the reinforcing plate, to lock the positioning protrusions into the indentations to provide a firm combination of the body with the reinforcing plate.

6. The connector of claim 1, wherein the reinforcing plate is combined with the back of the contact pad of the flexible printed circuit board.

7. The connector of claim 1, wherein the flexible printed circuit board is formed as a shape of stairs so as to match up to the height of the body.

8. The connector of claim 1, wherein the terminals of the electronic component are elastic terminals.

9. The connector of claim 1, wherein the reinforcing plate is a hardened resin with which the back of the contact pad is coated.

10. A connector for connecting a contact pad of a flexible printed circuit board against terminals of an electronic component, comprising:

a body, which is combined with the electronic component, said body having two parallel sliding channels in positions corresponding to two sides of the terminals of the electronic component; and a reinforcing plate, which is combined with the contact pad of the flexible printed circuit board so as to increase the stiffness of the contact pad;

wherein the flexible printed circuit board is formed with the shape of stairs so as to match up to the height of the body and two sides of the reinforcing plate cooperate with the two parallel sliding channels of the body, thereby the contact pad of the flexible printed circuit board is connected against the terminals of the electronic component.

11. The connector of claim 10, wherein the body has a container for receiving the electronic component, and the terminals protrude from the container when the electronic component is received in the container.

12. The connector of claim 10, wherein the electronic component includes a speaker, a receiver, a microphone or an oscillator.

13. The connector of claim 10, wherein the electronic component is a speaker, and the bottom of the container has an opening therein and the sound of the speaker comes out from the opening and the area of the opening is smaller than the area of the speaker.

14. The connector of claim 10, wherein the body and the electronic component are formed in one piece.

15. The connector of claim 10, wherein a positioning protrusion is mounted at each sliding channel of the body, and an indentation is mounted at a corresponding location of each of the two sides of the reinforcing plate to lock the positioning protrusions into the indentations to provide a firm combination of the body with the reinforcing plate.

16. The connector of claim 10, wherein the reinforcing plate is combined with the back of the contact pad of the flexible printed circuit board.

17. The connector of claim 10, wherein the terminals of the electronic component are elastic terminals.

18. The connector of claim 10, wherein the reinforcing plate is a hardened resin with which the back of the contact pad is coated.

* * * * *